US008469670B2

(12) United States Patent
Fulayter et al.

(10) Patent No.: US 8,469,670 B2
(45) Date of Patent: Jun. 25, 2013

(54) FAN ASSEMBLY

(75) Inventors: Roy David Fulayter, Avon, IN (US); Bradley T. Fanton, Plainfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 944 days.

(21) Appl. No.: 12/549,071

(22) Filed: Aug. 27, 2009

(65) Prior Publication Data

US 2011/0052398 A1 Mar. 3, 2011

(51) Int. Cl.
*F01D 5/30* (2006.01)

(52) U.S. Cl.
USPC ..... 416/221; 416/500

(58) Field of Classification Search
USPC ..... 415/119; 416/220 R, 221, 190, 203, 416/500
See application file for complete search history.

(56) References Cited

U.S. PATENT DOCUMENTS

| | | | | |
|---|---|---|---|---|
| 1,639,247 | A | | 8/1927 | Zoelly et al. |
| 1,970,435 | A | | 8/1934 | Sharp |
| 2,292,072 | A | | 8/1942 | Hanna et al. |
| 2,823,895 | A | | 2/1958 | Floroff |
| 2,916,258 | A | | 12/1959 | Klint |
| 2,934,259 | A | | 4/1960 | Hausmann |
| 2,948,506 | A | | 8/1960 | Glasser et al. |
| 3,347,520 | A | | 10/1967 | Owczarek |
| 3,644,058 | A | | 2/1972 | Barnabei et al. |
| 3,709,631 | A | | 1/1973 | Karstensen et al. |
| 3,751,183 | A | | 8/1973 | Nichols et al. |
| 4,019,833 | A | | 4/1977 | Gale |
| 4,021,138 | A | * | 5/1977 | Scalzo et al. ..... 416/95 |
| 4,097,192 | A | | 6/1978 | Kulina |
| 4,182,598 | A | | 1/1980 | Nelson |
| 4,192,633 | A | | 3/1980 | Herzner |
| 4,279,572 | A | | 7/1981 | Auriemma |
| 4,349,318 | A | | 9/1982 | Libertini et al. |
| 4,405,285 | A | | 9/1983 | Surdi |
| 4,494,909 | A | | 1/1985 | Forestier |
| 4,721,434 | A | | 1/1988 | Marshall et al. |
| 4,723,889 | A | * | 2/1988 | Charreron et al. ..... 416/193 A |
| 4,872,812 | A | | 10/1989 | Hendley et al. |
| 4,936,749 | A | | 6/1990 | Arrao et al. |
| 4,967,550 | A | | 11/1990 | Acton et al. |
| 5,005,353 | A | | 4/1991 | Acton et al. |
| 5,230,603 | A | | 7/1993 | Day |
| 5,286,168 | A | | 2/1994 | Smith |
| 5,302,085 | A | | 4/1994 | Dietz et al. |

(Continued)

FOREIGN PATENT DOCUMENTS

| | | | |
|---|---|---|---|
| EP | 0 213 981 | A1 | 3/1987 |
| EP | 0 420 371 | A1 | 4/1991 |
| GB | 2 455 431 | A | 6/2009 |

OTHER PUBLICATIONS

European Search Report issued in European Patent Application No. 10251146.6, mailed May 10, 2012, 8 pages.

*Primary Examiner* — Nathaniel Wiehe
*Assistant Examiner* — Ryan Ellis
(74) *Attorney, Agent, or Firm* — Krieg DeVault LLP

(57) ABSTRACT

A fan assembly is disclosed herein. The fan assembly includes a fan operable to rotate about an axis. The fan includes a hub and a plurality of blades extending radially from the hub relative to the axis. The fan also includes a reinforcing member positioned adjacent to the fan along the axis. The reinforcing member contacts a predetermined subset of less than all of the plurality of blades.

27 Claims, 4 Drawing Sheets

U.S. PATENT DOCUMENTS

| | | | | |
|---|---|---|---|---|
| 5,313,786 | A | 5/1994 | Chlus et al. | |
| 5,350,279 | A | 9/1994 | Prentice et al. | |
| 5,478,207 | A | 12/1995 | Stec | |
| 5,498,136 | A | 3/1996 | Namura et al. | |
| 5,501,575 | A | 3/1996 | Eldredge et al. | |
| 5,540,551 | A | 7/1996 | Heinig | |
| 5,567,114 | A | 10/1996 | Wallace | |
| 5,573,375 | A | 11/1996 | Barcza | |
| 5,620,303 | A | 4/1997 | Moffitt et al. | |
| 5,667,361 | A | 9/1997 | Yaeger et al. | |
| 5,913,660 | A | 6/1999 | Knott | |
| 5,988,982 | A | 11/1999 | Clauer | |
| 5,993,161 | A | 11/1999 | Shapiro | |
| 6,042,338 | A | 3/2000 | Brafford et al. | |
| 6,195,982 | B1 | 3/2001 | Gysling et al. | |
| 6,379,111 | B1 | 4/2002 | Katoh et al. | |
| 6,379,112 | B1 | 4/2002 | Montgomery | |
| 6,428,278 | B1 | 8/2002 | Montgomery et al. | |
| 6,457,942 | B1 | 10/2002 | Forrester | |
| 6,471,482 | B2 | 10/2002 | Montgomery et al. | |
| 6,520,743 | B2 * | 2/2003 | Arilla et al. | 416/220 R |
| 6,524,074 | B2 | 2/2003 | Farrar et al. | |
| 6,582,183 | B2 | 6/2003 | Eveker et al. | |
| 6,659,725 | B2 | 12/2003 | Yeo et al. | |
| 6,814,543 | B2 | 11/2004 | Barb et al. | |
| 7,082,371 | B2 | 7/2006 | Griffin et al. | |
| 7,147,437 | B2 | 12/2006 | Burdgick et al. | |
| RE39,630 | E | 5/2007 | Stangeland et al. | |
| 7,252,481 | B2 | 8/2007 | Stone | |
| 7,258,529 | B2 | 8/2007 | Wagner | |
| 7,264,447 | B2 | 9/2007 | Ono et al. | |
| 7,465,149 | B2 * | 12/2008 | Dixon et al. | 415/116 |
| 7,500,299 | B2 | 3/2009 | Dupeux et al. | |
| 7,500,832 | B2 | 3/2009 | Zagar et al. | |
| 7,520,718 | B2 | 4/2009 | Engle | |
| 7,530,791 | B2 | 5/2009 | Douville et al. | |
| 2007/0154314 | A1 | 7/2007 | Jarrah et al. | |
| 2008/0008593 | A1 * | 1/2008 | Zagar et al. | 416/220 R |
| 2008/0180938 | A1 | 7/2008 | Liu et al. | |

* cited by examiner

FAN ASSEMBLY

BACKGROUND OF THE INVENTION

1. Field of the Invention

The invention relates to varying the frequency of the blades of a fan assembly.

2. Description of Related Prior Art

U.S. Pat. No. 7,252,481 is entitled "Natural Frequency Tuning of Gas Turbine Engine Blades." The '481 patent discloses a blade referenced at 32 in FIG. 2. The blade 32 includes a blade root referenced at 42. A tuning notch referenced at 50 is defined in the back of a blade root 42 to tune the natural frequency of the blade 32.

SUMMARY OF THE INVENTION

In summary, the invention is a fan assembly. The fan assembly includes a fan operable to rotate about an axis. The fan includes a hub and a plurality of blades extending radially from the hub relative to the axis. The fan also includes a reinforcing member positioned adjacent to the fan along the axis. The reinforcing member contacts a predetermined subset of less than all of the plurality of blades.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
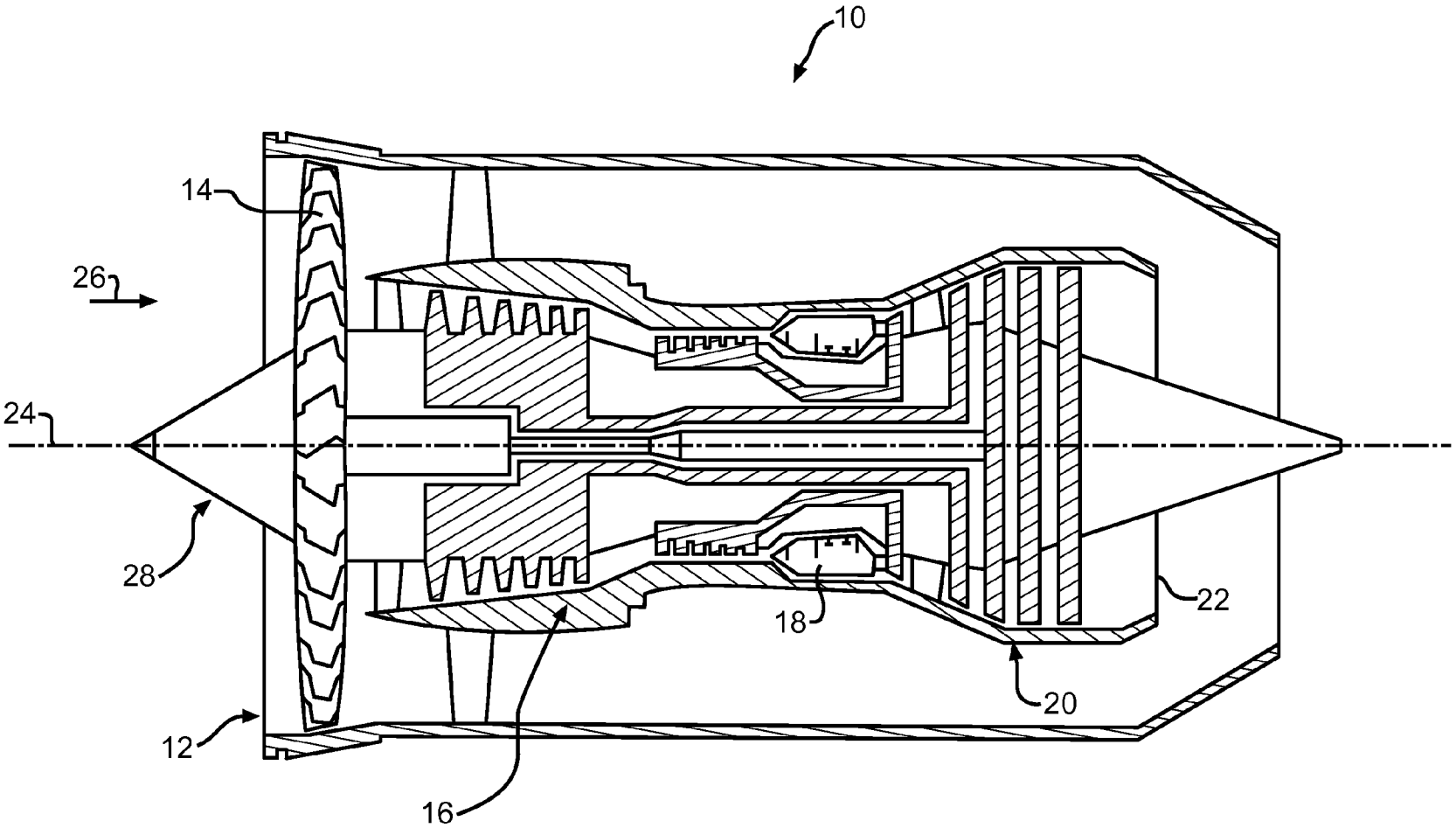
FIG. 1 is a simplified cross-section of a turbine engine according to an embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as exemplified in the embodiments described below, can be applied to improve the efficiency of a turbine engine. The efficiency can be improved by reducing the impact of fan blade flutter. Flutter occurs when the energy associated with a fluid stream is extracted from the fluid stream and expended in the form of vibration of a working member disposed in the fluid stream. The blades can also enjoy longer life if flutter is reduced since high cycle fatigue would be reduced.

Referring to FIG. 1, a turbine engine 10 can include an inlet 12 and a fan 14. The exemplary fan 14 can be a bladed disk assembly having a disk or hub defining a plurality of slots and a plurality of fan blades, each fan blade received in one of the slots. The turbine engine can also include a compressor section 16, a combustor section 18, and a turbine section 20. The turbine engine 10 can also include an exhaust section 22. The fan 14, compressor section 16, and turbine section 20 are all arranged to rotate about a centerline axis 24. Fluid such as air can be drawn into the turbine engine 10 as indicated by the arrow referenced at 26. The fan 14 directs fluid to the compressor section 16 where it is compressed. The compressed fluid is mixed with fuel and ignited in the combustor section 18. Combustion gases exit the combustor section 18 and flow through the turbine section 20. Energy is extracted from the combustion gases in the turbine section 20.

A nose cone assembly 28 can be attached to the fan 14. As set forth above and shown in FIG. 2, the exemplary fan 14 can be a bladed disk assembly having a disk or hub 30 defining a plurality of slots. A spinner body 34 of the nose cone assembly 28 can be attached to the hub 30. The bladed disk assembly 14 can also include a plurality of fan blades 32. Each fan blade 32 can be received in one of the slots of the hub 30. The blades 32 are circumferentially spaced from one another about the axis 24 (shown in FIG. 1). Each blade 32 can include an airfoil portion 36 extending into the flow path, a platform 38 that can be flush with the spinner body 34, and a root portion 40 received in the slot of the hub 30. The platform defines the inner boundary of the flow path.

A front retainer 42 can connect the spinner body 34 and the hub 30 together and also prevent forward movement of the blades 32. A seal plate 44 can be fixed to the hub 30 on the aft side of the blades 32 and prevent aft movement of the blades 32. In the exemplary embodiments of the invention, the seal plate 44 can define a reinforcing member for the blades to change the natural frequency of less than all of the blades 32. The fan 14 and seal plate 44 can together define a fan assembly according to an embodiment of the invention. However, it is noted that in other embodiments of the invention a structure other than a seal plate can be applied to contact and stiffen less than all of the blades 32.

As set forth above, the exemplary fan 14 is operable to rotate about an axis 24. The axis 24 can be the central axis of the fan 14. In alternative embodiments of the invention, the fan 14 can be eccentric relative to the axis of rotation. The reinforcing member 44 contacts a predetermined subset of less than all of the plurality of blades 32. In the invention, the contact between the reinforcing member 44 and a subset of less than all the blades is predetermined.

In various embodiments of the invention, the reinforcing member 44 can contact every other blade 32. Alternatively, the reinforcing member 44 can contact every third or fourth blade 32. Alternatively, the reinforcing member 44 can contact two adjacent blades 32 and be spaced from the blades 32 on opposite sides of the adjacent blades 32. The reinforcing member 44 can contact less than half of the plurality of blades 32 or more than half of the blades 32. The blades 32 that are contacted are reinforced such that the reinforced blades 32 have increased stiffness and have a different frequency than a blade 32 that is not reinforced.

Figure 2:
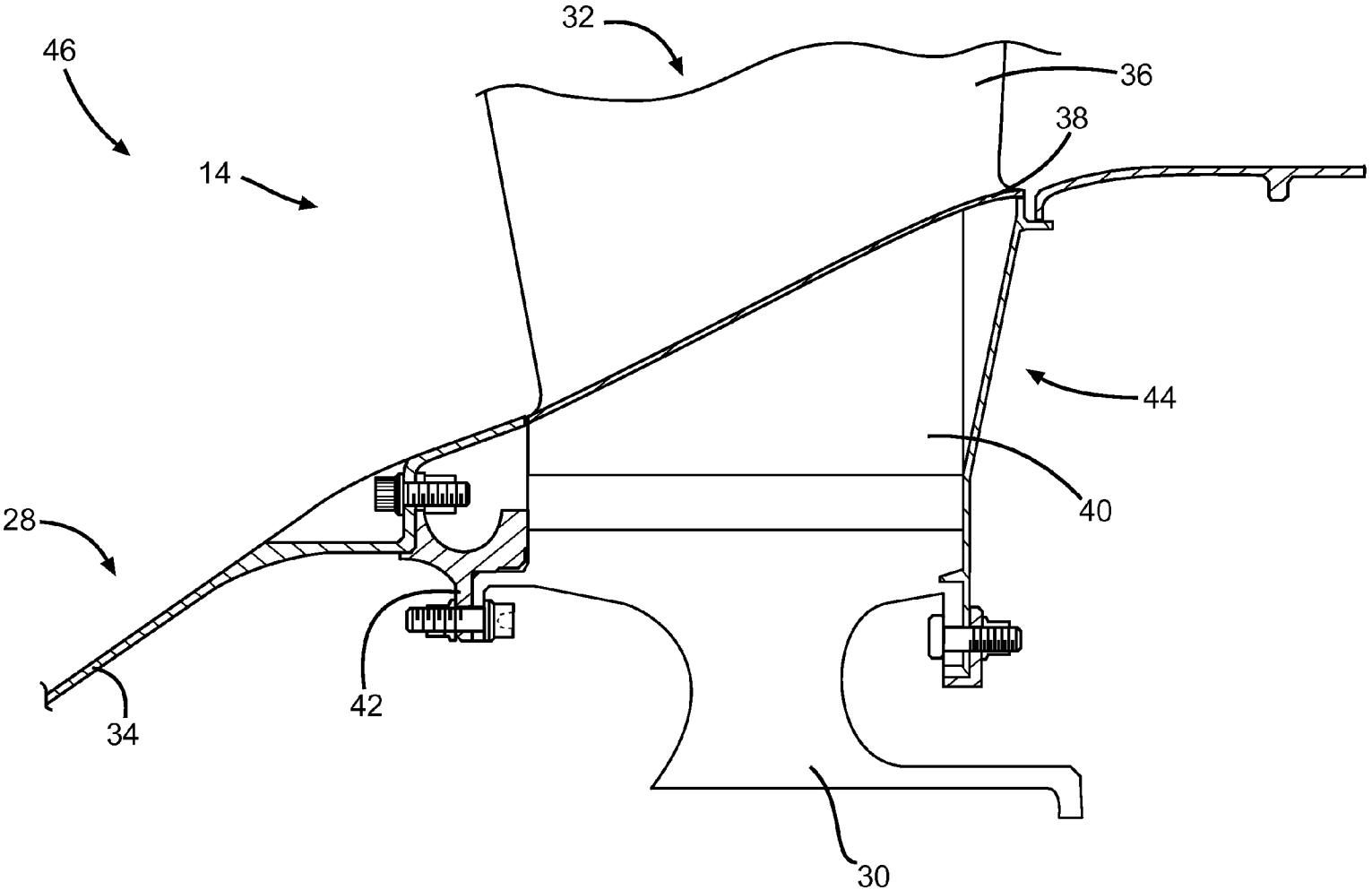
FIG. 2 is a cross-section of a fan shown schematically in FIG. 1
Figure 3:
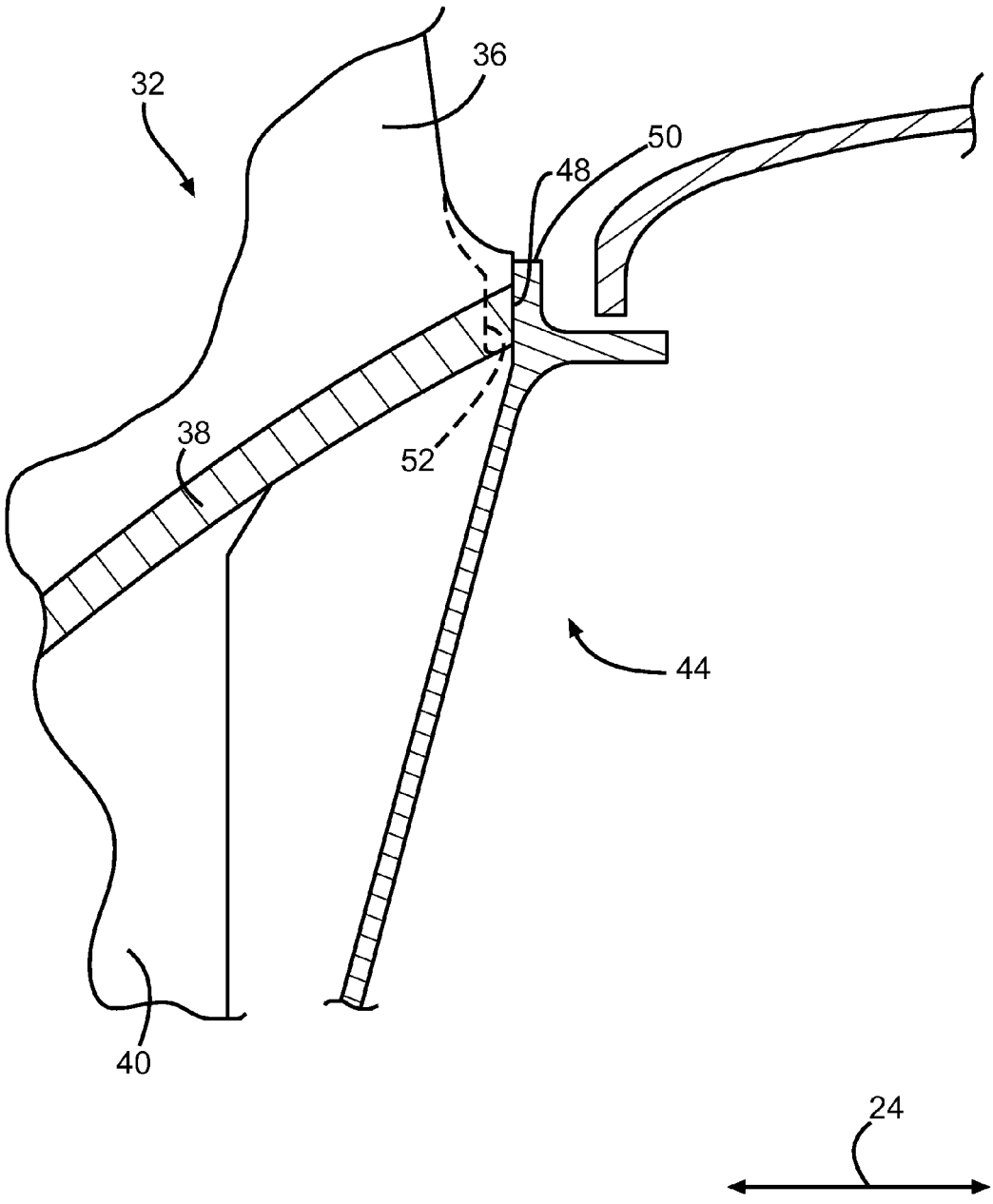
FIG. 3 is an enlarged portion of FIG. 2.

FIG. 3 is a magnified portion of FIG. 2 and shows a first embodiment of the invention. Each of the predetermined subset of blades 32 can be longer along the axis 24 than each of the remaining blades 32. In FIG. 3, the platform 38 of the blade 32 defines an axially aft edge 48. The reinforcing member 44 and the edge 48 contact one proximate to an outer diameter 50 of the reinforcing member 44. The contact between the platform 38 and the reinforcing member 44 at the edge 48 reinforces and stiffens the blade 32.

FIG. 3 also shows an axially aft edge 52 of an adjacent blade in phantom. The blade defining the edge 52 can be immediately adjacent to the blade 32 or spaced further about the axis 24 from the visible blade 32. FIG. 3 shows a gap between the reinforcing member 44 and the edge 52. Thus, the blade defining the edge 52 is shorter than the visible blade 32 along the axis 24. Also, the blade defining the edge 52 is not reinforced and stiffened as the visible blade 32.

In the first embodiment of the invention, the reinforcing member 44 can seal the fan 14. However, as set forth above, a structure other than a seal plate can be applied to reinforce some of the blades. It is also noted that the blades can be reinforced at the forward end, rather than the aft end as shown in the first exemplary embodiment.

Figure 4:
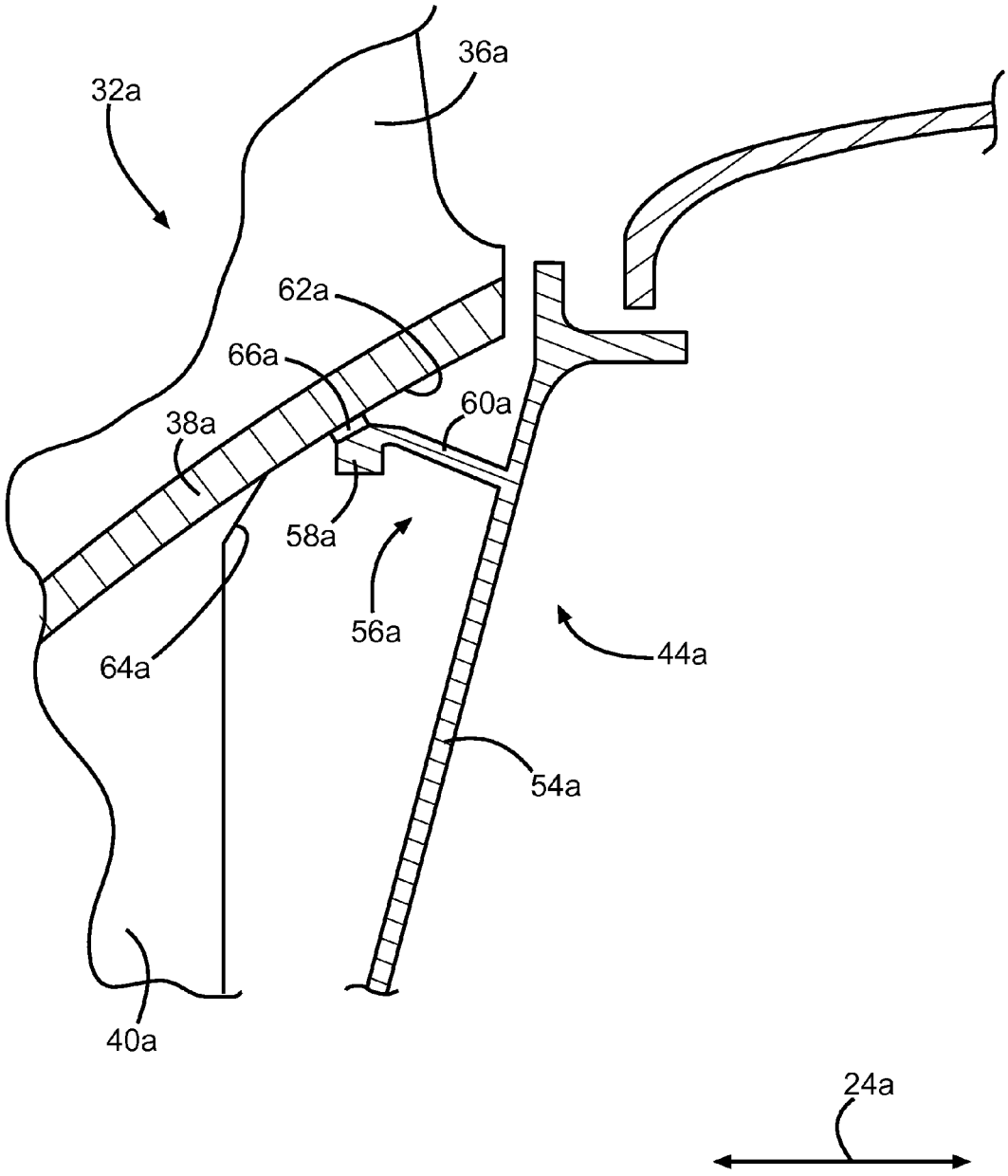
FIG. 4 is cross-section similar to FIG. 3 but of a second embodiment of the invention.

FIG. 4 shows a second embodiment of the invention. A blade 32*a* can include an airfoil portion 36*a*, a platform 38*a*, and a root portion 40*a*. A reinforcing member 44*a* can include a plate portion 54*a* operable to seal against the fan 14. The gap between the plate portion 54*a* and the platform 38*a* is permissible and will not preclude sealing.

The reinforcing member 44*a* can also include one or more arms 56*a* projecting at least partially along the axis 24*a*. The exemplary arm 56*a* extends partially along the axis 24*a* and radially in part. Each arm 56*a* can extend cantilevered from the plate portion 54*a* to a respective distal end 58*a*. The arms 56*a* of the reinforcing member 44*a* can contact a radially inward side 62*a* of platforms 38*a* of the predetermined subset of blades 32*a*. In alternative embodiments, the reinforcing member 44*a* could contact the blade 32*a* radially inward of the platform 38*a*, such as at a point 64*a*.

The exemplary arm 56*a* can include a shaft portion 60*a* extending from the plate portion 54*a*. The distal end 58*a* can be a protuberance thicker than the shaft portion 60*a*. The thicker distal end 58*a* having greater mass can enhance the stiffness of the blade 32*a*. However, the arm 56*a* can have a constant thickness in alternative embodiments of the invention.

The exemplary reinforcing member 44*a* is shown as a unitary structure wherein the plate portion 54*a* and the one or more arms 56*a* are integrally-formed with respect to one another. In alternative embodiments of the invention, the reinforcing member 44*a* can be multiple structures formed separately and joined (releasably or fixed) in operation. For example, the plate portion 54*a* can be similar to the reinforcing member 44 shown in FIG. 3 and another structure defining the arms 56*a* could be positioned between the hub and the plate portion 54*a*.

A quantity 66*a* of lubricating material can be positioned between the reinforcing member 44*a* and the blade 32*a*. The quantity 66*a* can be formed from a solid lubricant material or from any material having properties that enhance sliding movement between the arm 56*a* and the surface 62*a*. The blade 32*a* and the reinforcing member 44*a* can be movable relative to one another without compromising the stiffening provided by the reinforcing member 44*a*. The lubricant could be a wear coating on one or both of the reinforcing member 44*a* and the blade 32*a*.

In some embodiments of the invention, the reinforcing member 44*a* can be resiliently deformed by engagement with the blade 32*a* such that a pressing load is generated on the blade 32*a*. For example, in the first embodiment shown in FIG. 3, the outer diameter 50 can be moved along the axis 24 relative to an inner diameter of the reinforcing member 44 when the fan 14 (shown in FIG. 2) is installed. This elastic deformation can result in a pressing load on the platform 38 and enhance the stiffening of the blade 32. Similarly, in the second embodiment shown in FIG. 4, the arm 56*a* can be rotated counter-clockwise (based on the perspective of FIG. 4) when the fan 14 (shown in FIG. 2) is installed. It is noted that embodiments of the invention can be applied in any fluid compression system using blades, in addition to fans as disclosed above.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The right to claim elements and/or sub-combinations of the combinations disclosed herein is hereby reserved.

What is claimed is:

1. A fan assembly comprising:

a fan operable to rotate about an axis and including a hub and a plurality of blades extending radially from said hub relative to said axis, each of said blades including a platform defining an inner boundary of a flow path and an airfoil extending radially from the platform and into the flow path; and an annular reinforcing member extending annularly about said axis, said annular reinforcing member positioned adjacent to said fan along said axis and contacting the platform of a predetermined subset of more than one but less than all of said plurality of blades.

2. The fan assembly of claim 1 wherein said plurality of blades are circumferentially spaced from one another about said hub and wherein said predetermined subset of blades in contact with said reinforcing member comprises every other one of said plurality of blades.

3. The fan assembly of claim 1 wherein said reinforcing member contacts less than half of said plurality of blades.

4. The fan assembly of claim 1 wherein said reinforcing member further comprises:

a plate portion operable to seal against said fan; and one or more arms projecting along said axis from said plate portion to a distal end contacting the platform of at least one of said predetermined subset of blades.

5. The fan assembly of claim 4 wherein said plate portion and said one or more arm are integrally-formed with respect to one another.

6. The fan assembly of claim 1 wherein said reinforcing member contacts said fan at respective axial ends of the platforms of said predetermined subset of blades.

7. The fan assembly of claim 1 wherein said reinforcing member contacts said fan at respective radially inward sides of the platforms of said predetermined subset of blades.

8. The fan assembly of claim 1 wherein said annular reinforcing member extends about an entire circumference of said fan.

9. The fan assembly of claim 1 wherein said hub defines a plurality of slots and wherein each of said plurality of blades are received in one of said plurality of slots.

10. The fan assembly of claim 1 wherein said reinforcing member further comprises:

a plate portion operable to seal against said fan and prevent aft movement of each of the plurality of blades; and a plurality of arms projecting from said plate portion along said axis to respective distal ends, each distal end contacting at least one of said predetermined subset of blades.

11. The fan assembly of claim 10 wherein each of said plurality of arms includes a shaft portion extending from said plate portion and a protuberance at said distal end thicker than said shaft portion.

12. The fan assembly of claim 1 wherein said reinforcing member contacts said platform of each of said predetermined subset of said plurality of blades to increase a stiffness of said predetermined subset of said plurality of blades relative to a non-reinforced subset of said plurality of blades that are not contacted by said reinforcing member.

13. The fan assembly of claim 1 wherein said reinforcing member is fixed to said hub.

14. A fan assembly comprising:

a fan operable to rotate about an axis and including a hub and a plurality of blades extending radially from said hub relative to said axis, each of said blades including a platform defining an inner boundary of a flow path and an airfoil extending radially from the platform and into the flow path; and a reinforcing member positioned adjacent to said fan along said axis and contacting the platform of a predetermined subset of more than one but less than all of said plurality of blades;

wherein the platform of each of said predetermined subset of blades is longer along said axis than the platform of each of the remaining blades.

15. A fan assembly comprising:

a fan operable to rotate about an axis and including a hub and a plurality of blades extending radially from said hub relative to said axis;

a reinforcing member positioned adjacent to said fan along said axis and contacting a predetermined subset of less than all of said plurality of blades; and a quantity of lubricating material positioned between said reinforcing member and said predetermined subset of blades.

16. A method comprising the steps of:

rotating a fan including a hub and a plurality of blades extending radially from the hub about an axis, each of the blades including a platform defining an inner boundary of a flow path and an airfoil extending radially from the platform and into the flow path; and positioning an annular reinforcing member extending annularly about the axis adjacent to the fan along the axis such that the reinforcing member contacts the platform of a predetermined subset of more than one but less than all of the plurality of blades.

17. The method of claim 16 wherein said positioning step is further defined as:

reinforcing less than all of the plurality of blades to increase the stiffness of only the reinforced blades.

18. The method of claim 16 further comprising the step of:

sealing the fan with the reinforcing member.

19. The method of claim 16 wherein said positioning step includes the step of:

contacting at least some axially aft edges of the platforms of each of the predetermined subset of blades with an outer diameter of the reinforcing member.

20. The method of claim 16 wherein said positioning step includes the step of:

contacting at least some of the predetermined subset of the blades radially inward of the respective platforms of the at least some of the predetermined subset of the blades with the reinforcing member.

21. The method of claim 16 wherein the annular reinforcing member extends about an entire circumference of the fan.

22. A turbine engine comprising:

a fan operable to rotate about a centerline axis and including a hub defining a plurality of slots and a plurality of blades extending radially from said hub and each received in one of said plurality of slots;

a spinner body connected to a forward side of said hub; and a reinforcing member positioned adjacent to an aft side of said fan along said centerline axis and contacting a predetermined subset of less than all of said plurality of blades; and wherein platforms of each of said predetermined subset of blades is longer along said axis than each of the remaining blades and wherein an outer diameter of said reinforcing member presses against respective axially aft ends of said platforms.

23. A fan assembly comprising:

a fan operable to rotate about an axis and including a hub and a plurality of blades extending radially from said hub relative to said axis, each of said blades including a platform defining an inner boundary of a flow path and an airfoil extending radially from the platform and into the flow path; and a reinforcing member positioned adjacent to said fan along said axis and contacting the platform of a predetermined subset of more than one but less than all of said plurality of blades;

wherein said reinforcing member and said platform of said predetermined subset of said plurality of blades contact one another along a diameter of said reinforcing member; and wherein said reinforcing member and a non-reinforced subset of said plurality of blades are spaced from one another along said diameter of said reinforcing member.

24. A fan assembly comprising:

a fan operable to rotate about an axis and including a hub and a plurality of blades extending radially from said hub relative to said axis; and a reinforcing member positioned adjacent to said fan along said axis and contacting a predetermined subset of less than all of said plurality of blades;

wherein each of said plurality of blades has an axially-facing aft edge;

wherein said reinforcing member contacts said aft edge of said predetermined subset of said plurality of blades; and wherein said reinforcing member is spaced from said aft edge of a non-reinforced subset of said plurality of blades.

25. A fan assembly comprising:

a fan operable to rotate about an axis and including a hub and a plurality of blades extending radially from said hub relative to said axis, each of said blades including a platform defining an inner boundary of a flow path and an airfoil extending radially from the platform and into the flow path; and a reinforcing member positioned adjacent to said fan along said axis and contacting the platform of a predetermined subset of more than one but less than all of said plurality of blades;

wherein said platform of each of said plurality of blades has a radially-facing inward side;

said reinforcing member contacts said radially-facing inward side of said predetermined subset of said plurality of blades; and wherein said reinforcing member is spaced from said radially-facing inward side of a non-reinforced subset of said plurality of blades.

26. A method comprising the steps of:

rotating a fan including a hub and a plurality of blades extending radially from the hub about an axis, each of the blades including a platform defining an inner boundary of a flow path and an airfoil extending radially from the platform and into the flow path; and positioning a reinforcing member adjacent to the fan along the axis such that the reinforcing member contacts the platform of a predetermined subset of more than one but less than all of the plurality of blades;

wherein the reinforcing member and the platforms of the predetermined subset of the plurality of blades contact one another along a diameter of the reinforcing member; and wherein the reinforcing member and the platforms of a non-reinforced subset of the plurality of blades are spaced from one another along the diameter of the reinforcing member.

27. A turbine engine comprising:

a fan operable to rotate about a centerline axis and including a hub defining a plurality of slots and a plurality of blades extending radially from said hub and each received in one of said plurality of slots, each of said blades including a platform defining an inner boundary of a flow path and an airfoil extending radially from the platform and into the flow path;

a spinner body connected to a forward side of said hub; and a reinforcing member positioned adjacent to an aft side of said fan along said centerline axis and contacting the platform of a predetermined subset of more than one but less than all of said plurality of blades;

wherein the reinforcing member and the platforms of the predetermined subset of the plurality of blades contact one another along a diameter of the reinforcing member; and wherein the reinforcing member and the platforms of a non-reinforced subset of the plurality of blades are spaced from one another along the diameter of the reinforcing member.

* * * * *